United States Patent [19]

Benaroya

[11] Patent Number: 4,748,811

[45] Date of Patent: Jun. 7, 1988

[54] SUPERCHARGED DIESEL TYPE APPARATUS FOR THE GENERATION OF POWER

[76] Inventor: Henry Benaroya, 41, Boulevard du Commandant Charcot, 9200 Neuilly sur Seine, France

[21] Appl. No.: 906,290

[22] Filed: Sep. 11, 1986

[30] Foreign Application Priority Data

Sep. 11, 1985 [FR] France ..... 85 13480

[51] Int. Cl.[4] ..... F02B 71/04

[52] U.S. Cl. ..... 60/595; 123/68

[58] Field of Search ..... 60/595; 123/68

[56] References Cited

U.S. PATENT DOCUMENTS 4,481,772 11/1984 Benaroya ..... 60/595

FOREIGN PATENT DOCUMENTS 1238426 7/1960 France .

1116162 6/1968 United Kingdom .

*Primary Examiner*—Allen M. Ostrager

*Attorney, Agent, or Firm*—Fleit, Jacobson, Cohn & Price

[57] ABSTRACT

A power production apparatus comprises a Diesel engine having a plurality of sequentially operating motor cylinders and a plurality of alternating air compressor cylinders. Each motor cylinder has scavenge ports connected to receive scavenging air from that compressor cylinder whose compression stroke occurs while the scavenge ports of the motor cylinder are closed. An intake capacity having a volume equal to about five times the cubic capacity of the motor cylinder is located on the air path. The apparatus may consist of a gas turbine and a multi-tandem free piston gas generator and a gas turbine; the gas generator then has a plurality of Diesel type motor cylinders whose pistons are drivably connected to compression pistons.

8 Claims, 7 Drawing Sheets

SUPERCHARGED DIESEL TYPE APPARATUS FOR THE GENERATION OF POWER

BACKGROUND OF THE INVENTION

1. Field of the Art

The invention relates to apparatuses for the generation of power which comprise at least a Diesel engine having a plurality of sequentially operating cylinders which are supercharged by a plurality of alternating air compressor cylinders which deliver scavenging air to the engine.

2. Prior Art

Most existing Diesel engines which are supercharged by an alternating compressor having a plurality of cylinders which operate sequentially include a manifold which feeds all engine cylinders. All compressor cylinders open into that collector. As a consequence, the engine cylinders are scavenged under an inlet pressure which is approximately constant. A thermo-dynamic study of scavenging indicates that the work consumed for compression and air transfer is directly related to the difference between the mean inlet pressure of the scavenging air and the outlet pressure. As a consequence, the transfer work is determined by the mean pressure in the collector rather than by the outlet pressure of a particular compressor cylinder. However, if the apparatus has a single motor cylinder fed by a single compressor cylinder (as described for instance in French Pat. No. 1,238,426), the situation is completely different since there is no manifold which feeds a plurality of motor cylinders.

SUMMARY OF THE INVENTION

It is an object of the invention to provide an apparatus of the above type wherein the air transfer power consumption is substantially decreased. For that purpose, there is provided an apparatus wherein each motor cylinder is fed with scavenging air by that compressor cylinder whose compression stroke occurs while the scavenge air inlet ports are closed, through an intake capacity whose volume has a value which is several times greater (typically about five times greater) than the cubic capacity of an individual motor cylinder.

With that arrangement, scavenging occurs with an inlet pressure which steadily decreases during the scavenging stroke, whereby the transfer work is decreased. The related advantage may still be increased by providing the exhaust conduits of the motor cylinder with a constant cross-section close to the exhaust ports, then with a steadily and slowly increasing cross-sectional area. Then, there is a fast decrease of the pressure in the motor cylinder, first to a value of 1.5 Pe (where Pe is the pressure which prevails in an exhaust capacity), then to a value which is lower than the pressure which prevails in the exhaust capacity, due to generation of depression wave. The low pressure in the cylinder may remain until the piston has returned to a point where it closes the inlet ports.

The invention is particularly suitable for use in apparatuses which comprise a free piston gas generator of the multi-tandem type, associated with a gas turbine. Then the generator has a plurality of motor cylinders of the Diesel type, which are distributed in two sets which operate in phase opposition and has compressor cylinders which are also distributed in two sets. In European Pat. No. 7874, there is disclosed such an apparatus wherein some of the compression cylinders deliver a primary air flow which is directed to the engine cylinders while the other compression cylinders deliver a secondary flow which is directed to a gas turbine along with the exhaust gas of the motor cylinders. That arrangement has substantial advantages over the previous apparatuses when a greater part of the airflow delivered by the compressors is used for scavenging the engines. However, that advantage decreases as a greater part of the airflow is directed to the gas turbine. Then the construction of the present invention is of advantage and it is particularly easy to implement, since a compression chamber may be pneumatically associated with each motor cylinder. For instance, it is possible to feed each motor cylinder, defined by two oppositely moving motor pistons from a respective compressor chamber, so selected that the compression stroke of that compressor chamber occurs while the scavenge ports of the corresponding motor cylinder are closed.

The above-described arrangement substantially decreases the amount of gas energy consumption on exhaust. It can be implemented in a generator whose motor cylinders have conventional scavenge ports. Depending whether the scavenge ports are shaped for delivering a radial air jet or an air jet having a circumferential speed component, the air flow during a first portion of scavenging occurs differently. With a radial flow, the fresh scavenge air flows as a central jet, surrounded by an annular stream of hot combustion gas. That approach provides an efficient scavenging effect. But there is no rotation of the fresh air within the motor cylinder. On the other hand, with circumferentially tilted ports, the fresh air flows as a stable annular rotating sheet and a hot gas core remains in the central portion of the cylinder. Rotation still exists at the beginning of the combustion phase and improves it. As a counterpart, scavenging is less efficient since it does not sweep gas from the central part of the cylinder.

It is a further object of the invention to provide an apparatus having scavenging means which provide scavenging within the whole of the motor cylinder and simultaneously achieve a rotational air flow which improves combustion. For that purpose, there is provided an apparatus having a plurality of motor cylinders, wherein each motor cylinder has scavenge ports evenly distributed about the cylinder in an end portion of the latter and exhaust ports evenly distributed at circumferential intervals in the other end portion of the cylinder which is defined by two pistons whose movements occur in opposite directions. The scavenge ports are distributed in two rows which are opened in succession by one of the pistons. The ports of that row which is opened first are arranged for delivering a jet having a tangential component while the ports which are opened later are arranged for delivering a radially inwardly directed jet.

Both rows may typically be fed by a same intake capacity. However, means may preferably be provided for delaying delivery of scavenging air by the ports of the first row. That result may typically be obtained by providing a sinuous path or a secondary volume between the intake capacity (which directly feeds the ports of the second row) and the ports of the first row.

Then, the first row of ports, which deliver a jet which may for instance be at an angle of 30° with respect to the radial direction, generates a peripheral annular flow having a high rotational speed. The second row generates a central jet which does not rotate and provides efficient scavenging. During scavenging and later air compression, the central core of fresh air is steadily dragged by the peripheral rotating flow. As a result, they finally mix as an air body which rotates as a whole, at a speed which is lower than in those prior art engines which have sloped ports, however with the same favorable effect on combustion in the motor cylinder.

When two axially spaced rows of intake ports are provided and there are means for delaying delivering of fresh air through the ports of the first row, it may be possible to obtain a fresh air boundary surface which is approximately orthogonal to the cylinder axis and moves along the cylinder toward the exhaust ports.

In existing multi-tandem gas generators, each compressor cylinder (or at least each compression chamber) is generally associated with one predetermined air circuit. For instance, in the apparatus of European Pat. No. 7874, some of the compressor cylinders deliver a primary air flow to the engine while other compressor cylinders deliver secondary air flow to the turbine. Under such conditions, the scavenging ratio (i.e. the ratio between the air volume which flows across the engines and the capacity of the engines) is predetermined or at least cannot be modified except by large steps. It is a further object of the invention to provide means for more precisely adapting the scavenging ratio to the scavenging needs as defined above. With that purpose in mind, an apparatus according to the invention may have some compressor cylinders which are associated with one of the flow circuit only while other cylinders are associated with two flow circuits, by providing delivery check valves which open in two separate manifolds respectively connected to the primary air path and to the secondary air path.

The invention will be better understood from the following description of particular embodiments given by way of examples.

DETAILED DESCRIPTION OF PREFERRED EMBODIMENTS

Figure 1:
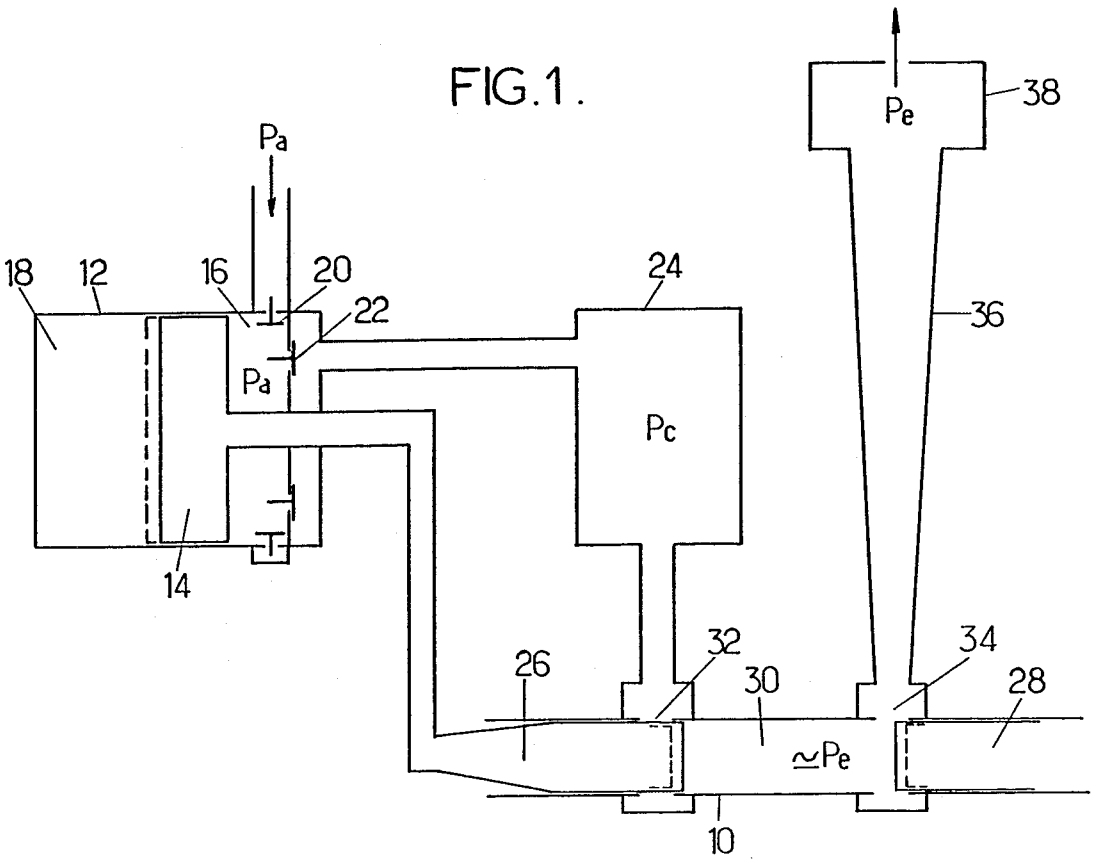
FIGS. 1, 2 and 3 schematically illustrate the arrangement of the components of a motor cylinder and a compressor cylinder of an apparatus according to an embodiment of the invention, at several phases of an operating cycle.
Figure 2:
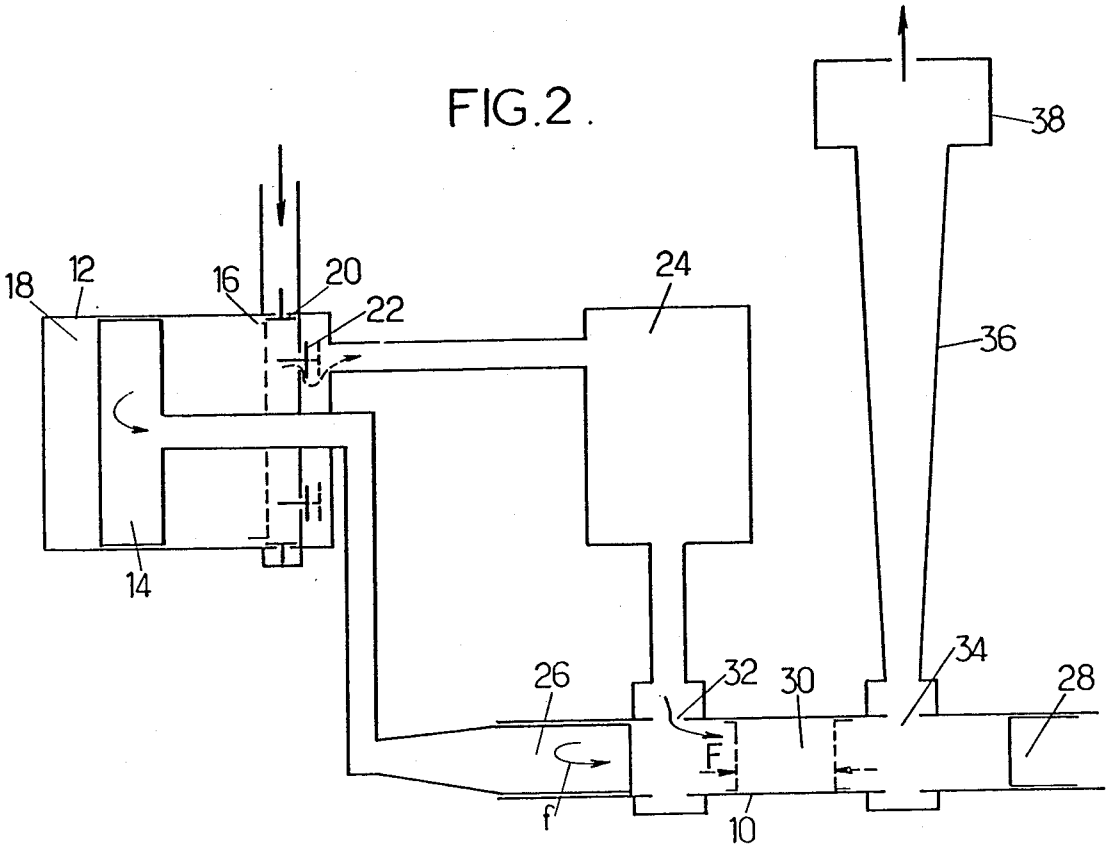
Figure 3:
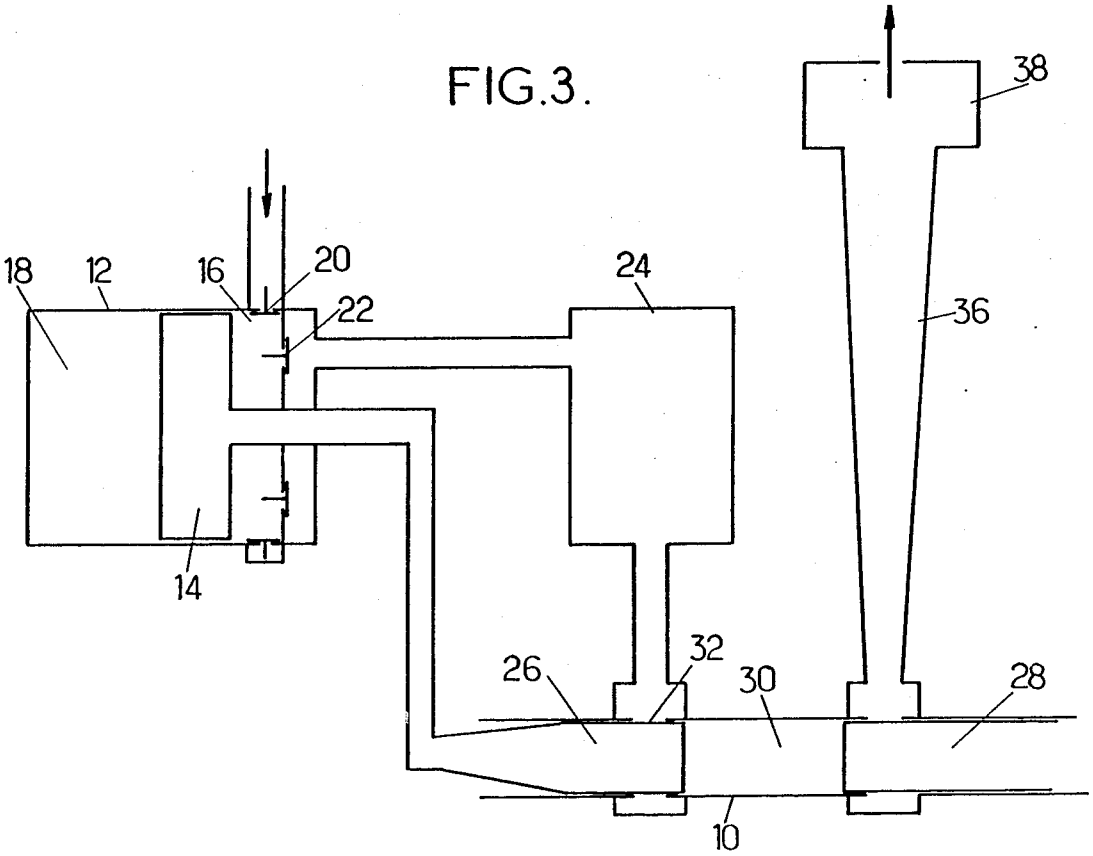

Referring to FIGS. 1–3, there will be described an operating cycle of a set comprising a motor cylinder 10 and a compressor cylinder 12 of a free piston gas generator which may have a general construction as described in European Pat. No. 7874, the content of which is included in the present specification by way of reference. The compressor cylinder 12 slidably receives a piston 14 which separates a compression chamber 16 associated with a primary flow path and a chamber 18 associated with a secondary flow path and which directly feeds a gas turbine (not shown). Chamber 16 is provided with air intake check valves 20 and with outlet check valves 22 opening into an intake capacity 24 for the motor cylinder 10. The piston 14 is positively connected to a motor piston 26 which defines, with a symmetrical piston 28, a motor compartment 30 which, when pistons 26 and 28 are at a maximum distance (that is at the outer dead point or ODP), has a volume which is about one fifth of the volume of capacity 24. Piston 26 co-operates with scavenge ports 32 for covering the uncovering them while piston 28 co-operates with exhaust ports 34 which open into a pipe 36 which communicates with an exhaust capacity 38 connected to a high pressure turbine (not shown). Referring to FIG. 1, the position of the movable unit comprising pistons 14 and 26 is indicated in full lines where it just opens the exhaust ports 34, i.e. when there is an exhaust "puff". Due to the different locations of ports 32 and 34, the scavenge ports are still closed. When the motor pistons further move apart from each other, the compression chamber 16 sucks air and piston 14 moves outboard away from the plate which carries check valves 20 and 22. A pressure Pc prevails in the intake capacity while the pressure in compressor compartment 16 is approximately equal to the intake pressure Pa. The pressure in motor cylinder 30 is approximately equal to the pressure Pe at the output of the exhaust pipe.

With an appropriate shape of the exhaust ports 34 and their connection with pipe 36, the overall pressure at the inlet of the pipe rapidly increases as the pistons move outboard and then attains a value of about 1.5 Pe.

As the motor pistons further move outwardly, they uncover the scavenge ports 32 as indicated in dash lines in FIG. 1. The intake capacity 24 is then connected to the motor cylinder 30. As soon as the pressure within the motor cylinder has decreased under Pc due to the exhaust "puff", the intake capacity 24 delivers air into the engine for scavenging.

The scavenging process proceeds until the movable units have moved to the ODP, as indicated in full lines in FIG. 2. Then, movement of the movable units is reversed, as indicated by arrows f. Scavenging of the engine still occurs as indicated by arrows F. The intake capacity 24 still communicates with the engine and is separated from the compressor by the check valves 22.

Compression in the engine and delivery from compressor cylinder 12 to the intake capacity 24 then begin. While the motor pistons 26 and 28 move toward each other (as indicated in dash lines in FIG. 2), pistons 26 and 28 successively close the scavenge ports 32, then the exhaust ports 34, and separate the engine from the intake capacity 24. Then, compressor cylinder 12 loads intake capacity 24 with air under an increasing pressure.

When the motor pistons come to the IDP and reverse their movements, fuel is injected into the engine and combustion begins.

Last, the expansion stroke occurs at the same time as that of the dead volume of the compressor while the intake capacity 24 remains separated (FIG. 3). The cycle begins again.

Scavenging under a variable pressure does not remove the drawbacks associated with the use of a single row of scavenging ports, as already indicated: scavenging is not complete if air is injected as tangential jets. There is no rotational movement which improves combustion if the jets are radially directed.

Figure 4:
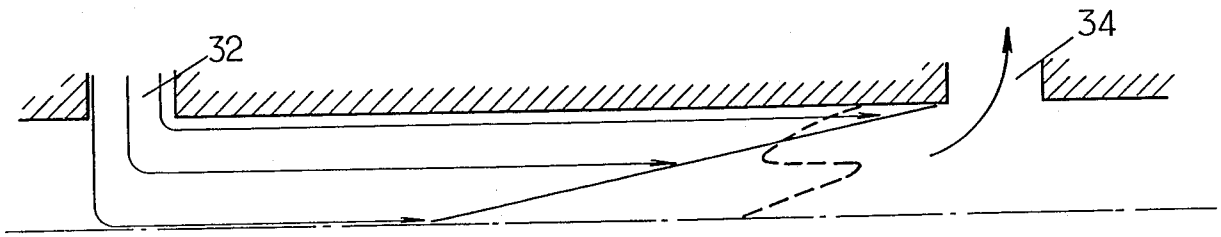
FIG. 4 is a cross-section along an axial plane of the motor cylinder, indicating how the boundary surface of the scavenging air is modified due to the invention.

Upon a first consideration, it would appear that it is possible to remove the difficulty with a spiral-shape of the scavenge ports for injecting air with a tangential component in the part of the ports which are closest to the midplane radially in the part which is farthest from the midplane. However, such ports would be difficult to machine and a problem would remain, due to the difference in length of the airpath. That difference would result into an air boundary having the shape illustrated in full lines on FIG. 4 when it reaches the exhaust ports. Consequently, a core of burnt gases would be trapped in the cylinder.

A scavenging system using two longitudinally offset rows of ports will now be described, which associates the advantages of radial scavenging to those of the rotary scavenging. An ancillary result consists in obtaining a boundary shape as indicated schematically in broken lines in FIG. 4, with limited modifications in design.

Figure 5:
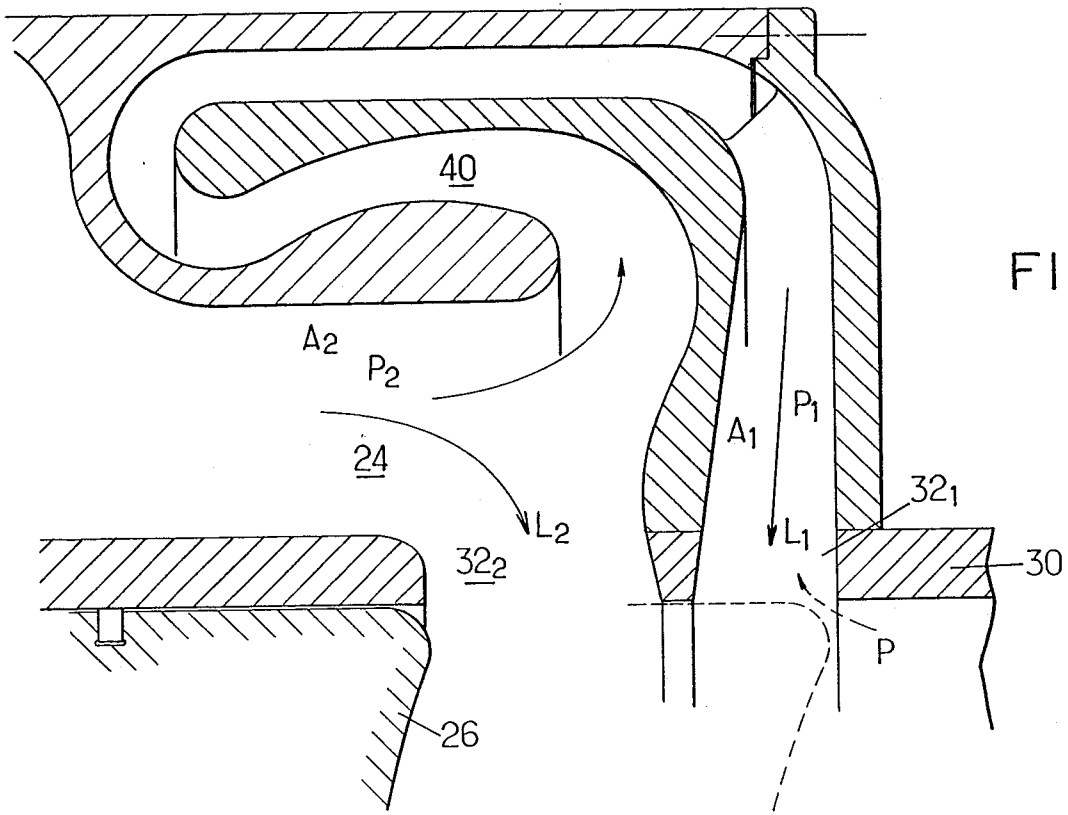
FIG. 5 is a section along a plane which passes through the axis of the motor cylinder, at an enlarged scale, illustrating a possible arrangement of the scavenge ports.
Figure 6:
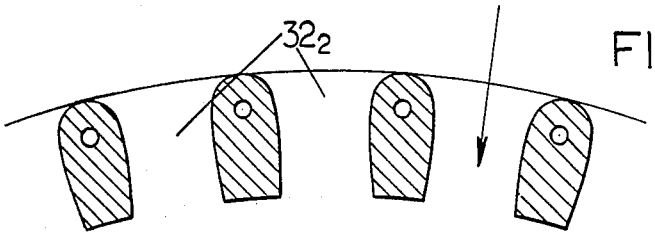
FIGS. 6 and 7 indicate the angular position of the scavenge ports of the two rows indicated in FIG. 5.
Figure 7:
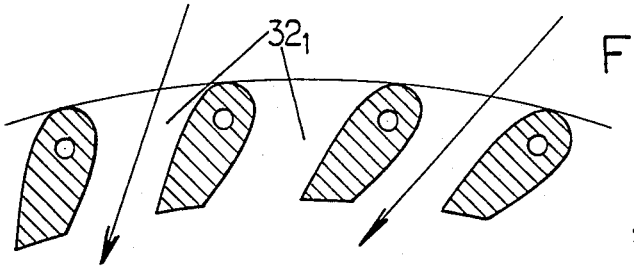

Referring to FIG. 5, where the components corresponding to those of FIG. 1 are designated by the same reference numeral, an intake capacity 24 arranged in the casing of cylinder 30 directly communicates with a row of intake or scavenge ports $32_2$ which radially open into the cylinder, as illustrated in FIG. 6. An other circumferential row of ports $32_1$, which are so located as to be opened first during the outboard stroke of piston 26, are located angularly. The angle between the direction of ports $32_1$ may be of about 30°, as indicated in FIG. 7.

Referring again to FIG. 5, means are provided for delaying delivery of an airflow through ports $32_1$ which are uncovered first. Such means decrease the motive pressure acting on the peripheral airflow delivered by ports $32_1$ and their speed. It further delays effective flow through ports $32_1$. Both results are obtained by locating a folded passage 40 between the intake capacity 24 and ports $32_1$. Passage 40 has a low volume as compared with that of the intake capacity but its length is much longer than the axial distance between the rows of ports $32_1$ and $32_2$. The passage has a phase shift effect and additionally impresses a head loss which lowers the overall feed pressure through ports $32_1$. Due to that arrangement, there is a slight backflow from the motor cylinder toward the capacity when piston 26 begins to uncover ports $32_1$, as indicated by a broken line arrow in FIG. 5. Due to the large length/width ratio of passage 40, there is no substantial mixing of scavenge cold air and burnt gas during that temporary backflow.

The size of passage 40 will depend upon the characteristics of each specific apparatus. However, the following rules will have to be obeyed:

the length of passage 40 is such that the difference between the pressure in intake capacity 24 and the pressure in the motor cylinder already reversed when the expansion wave due to reflection of the compression wave at the end of passage 24 reaches ports $32_1$, thereby limiting the backflow, the to-and-fro duration of the wave should be such that the piston 26 has uncovered ports $32_1$ completely at the time the wave returns.

The ports $32_2$ begin to open when the mass of air intaken by the motor cylinder through ports $32_1$ has the same order of magnitude than the gas weight initially forced from the motor cylinder into passage 40.

Other favorable results are obtained by providing two rows of ports and passage 40. Since an initial backflow of gas is accepted, the overall length of the scavenge ports $32_1$–$32_2$ may be increased by about 30% for the same useful cubic capacity. The phase lag impressed to the flow by ports $32_1$ slows down the peripheral part of the air boundary.

For obtaining that slowing action, the head losses along passage 40 are used. As a rule, passage 40 will be dimensioned for impressing an head loss of the same order of magnitude as that occuring across ports $32_1$. As a result, the air speed across the ports is reduced in a ratio which approximately corresponds to the ratio of the path length for the peripheral air streams and the path length for the air streams closer to the axis.

Figure 8:
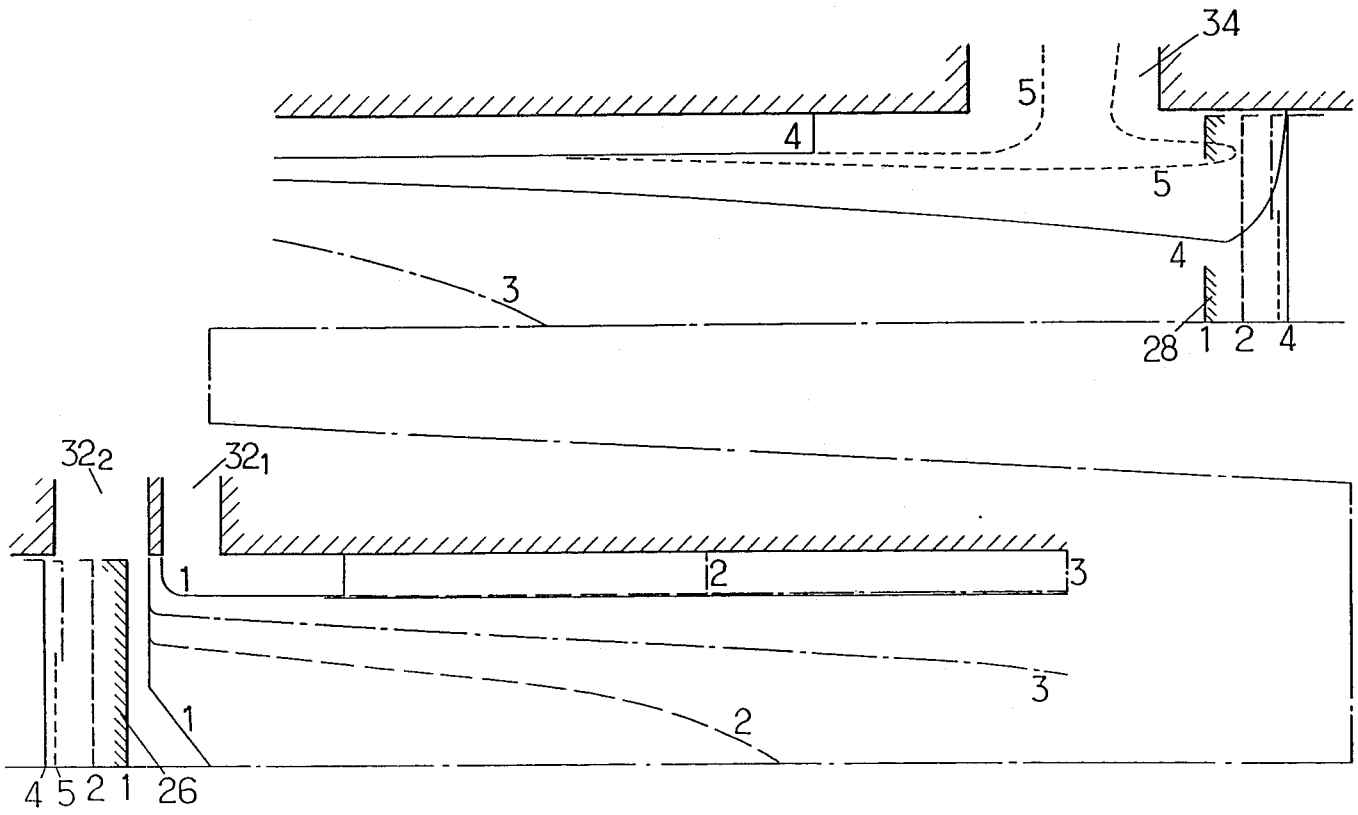
FIG. 8 schematically indicates how the boundary surface of the scavenging air moves along a motor cylinder provided with ports as illustrated in FIGS. 5–7.

Referring to FIG. 8, the successive locations of the air boundary along cylinder 30 when the ports are as illustrated in FIG. 5 have been determined by a mathematical simulation. References 1, 2, 3, 4 and 5 indicate the locations of the boundary when 2 ms, 6 ms, 10 ms, 16 ms and 20 ms, respectively have elapsed after the second row of ports begins to open.

For delaying airflow through ports $32_1$, other arrangements may be used. For instance, positively control valves or stream-loaded check valves may be located between the intake capacity and the ports $32_1$ of the first row.

Figure 9:
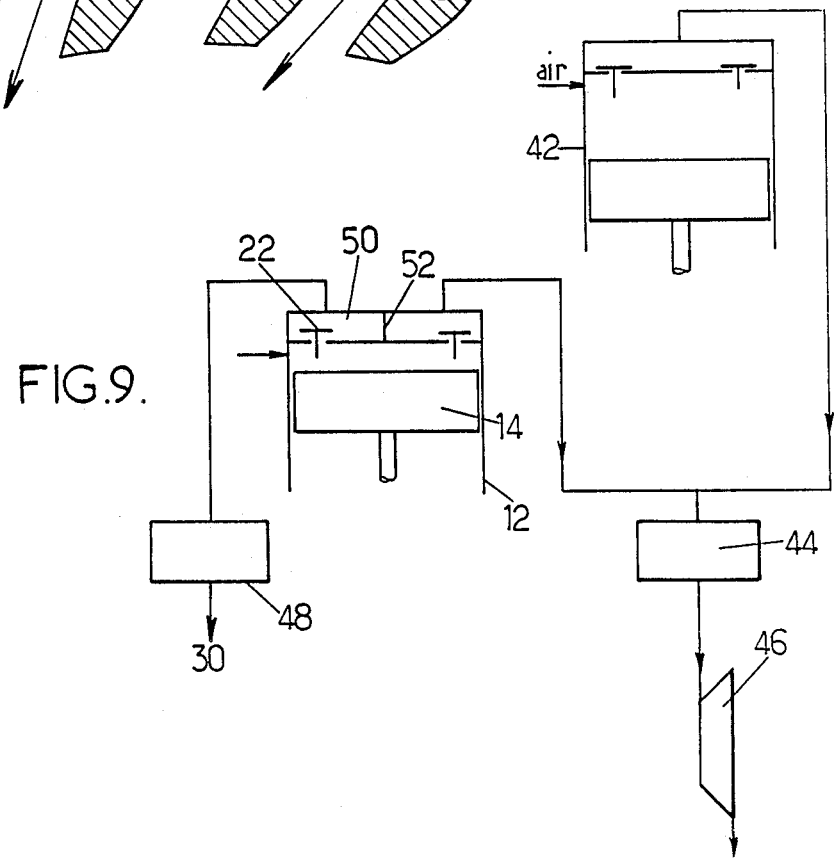
FIG. 9 is a schematic diagram of two compressors of an apparatus including a free piston gas generator, one of the two compressor cylinders being hybrid in that it is associated both with the primary air circuit and with the secondary air circuit.

Referring to FIG. 9, an arrangement will be described which makes it possible to better adapt the scavenging airflow delivered to the motor cylinders then in prior art apparatuses. The arrangement of FIG. 9 may be included in a gas generator whose general construction is as shown in European Pat. No. 7874, already mentioned. Two compressors only are illustrated in FIG. 9, while there are eight compressors in the gas generator of European Pat. No. 7874. Compressor 42 delivers air to a secondary circuit only, through a heat exchanger 44. Air flowing out of heat exchanger 44 is delivered to a high pressure gas turbine 46.

An other compressor cylinder 12 (or at least the other chamber defined by the compressor piston 14 in the first cylinder 12) is hybride in that it delivers air to the primary circuit, which includes an air cooler 48 and opens into a motor cylinder 30, and to the secondary circuit. For that, the outlet manifold 50 of cylinder 12 is separated in two chambers by a partition 52. Some of the outlet non-return check valves 22 of cylinder 12 open into one of the compartments while the other check valves open into the other compartment. Since the number of check valves is rather high, typically of from 10 to 20, accurate adjustment and adaptation may be achieved.

The construction of FIG. 9 further offers a much larger range of selection of the ratio between the primary airflow and the secondary airflow delivered by the compressors.

What is claimed:

1. Power production apparatus comprising a gas turbine and a multi-tandem free piston gas generator, said gas generator having a plurality of motor cylinders each slidably receiving a pair of oppositely acting motor pistons defining a motor chamber and having a plurality of compressor cylinders each having a double action compression piston drivably connected to at least one of said motor pistons and defining a pair of compression chambers in the respective compression cylinder, wherein each of said motor cylinders has scavenge port means located in an end portion thereof and exhaust port means located in the opposite end position thereof and connected to said turbine and wherein the scavenge port means of each of said motor cylinders are connected to that of said compression chambers whose compression stroke occurs while the scavenge port means of the connected motor cylinder are closed.

2. Apparatus according to claim 1, wherein the scavenge port means of each of said motor cylinders consist of two axially offset rows of circumferentially distributed ports, whereby the ports of a first of said rows are uncovered before the ports of the other row during outboard travel of the motor pistons.

3. Apparatus according to claim 2, wherein said ports of the first row are so constructed as to deliver air jets whose speed has a tangential component while the other ports are so constructed as to deliver a radial air jet.

4. Apparatus according to claim 3, wherein the jets delivered by the ports of the first row are at an angle of about 30° with a radial direction.

5. Apparatus according to claim 3, wherein both rows are fed through the respective compressor cylinder through a same intake capacity having a volume equal to several times the cubic capacity of the respective motor cylinder and delay means are provided for delaying air delivery to the first row of ports from said capacity.

6. Apparatus according to claim 5, wherein said delay means consist of a sinuous passage between said capacity and the ports of said first row.

7. Apparatus according to claim 5, wherein said delay means comprise check valve means located between the intake capacity and the ports of the first row.

8. Apparatus according to claim 1, wherein one at least of the compression chambers has first non-return check valves opening into a compartment communicating with the respective capacity and second outlet non-return check valves opening into a compartment communicating with an inlet of a high pressure gas turbine.

* * * * *